US008902116B2

(12) United States Patent
Huang et al.

(10) Patent No.: US 8,902,116 B2
(45) Date of Patent: Dec. 2, 2014

(54) FEED HORN

(71) Applicant: Wistron NeWeb Corporation, Hsinchu (TW)

(72) Inventors: Chang-Hsiu Huang, Hsinchu (TW); Shun-Chung Kuo, Hsinchu (TW); Chao-Kai Chan, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 202 days.

(21) Appl. No.: 13/751,167

(22) Filed: Jan. 28, 2013

(65) Prior Publication Data

US 2014/0125537 A1 May 8, 2014

(30) Foreign Application Priority Data

Nov. 8, 2012 (TW) ..... 101141613 A

(51) Int. Cl.
*H01Q 13/00* (2006.01)
*H01Q 13/02* (2006.01)

(52) U.S. Cl.
CPC ..... *H01Q 13/0208* (2013.01); *H01Q 13/0216* (2013.01)
USPC ..... 343/786

(58) Field of Classification Search
CPC ..... H01Q 13/0208; H01Q 13/0216; H01Q 5/0096
USPC ..... 343/772, 786, 840
See application file for complete search history.

(56) References Cited

U.S. PATENT DOCUMENTS

| | | | | |
|---|---|---|---|---|
| 6,208,309 | B1 * | 3/2001 | Chandler et al. | 343/786 |
| 6,816,123 | B2 * | 11/2004 | Eom et al. | 343/786 |
| 7,002,528 | B2 * | 2/2006 | Moheb | 343/781 R |
| 7,439,925 | B2 * | 10/2008 | Huang et al. | 343/786 |
| 7,755,557 | B2 * | 7/2010 | McGonigle et al. | 343/786 |
| 8,730,119 | B2 * | 5/2014 | Runyon et al. | 343/786 |

* cited by examiner

*Primary Examiner* — Tan Ho
(74) *Attorney, Agent, or Firm* — Winston Hsu; Scott Margo

(57) ABSTRACT

A feed horn for a Low Noise Block down converter is disclosed. The feed horn includes a conical body for gathering satellite signals and a connector coupled to the conical body for coupling the feed horn to a waveguide of the Low Noise Block down converter to transmit the satellite signals to the waveguide. The conical body includes a plurality of corrugations, one of the plurality of corrugations includes a plurality of first openings, and a plurality of second openings, each of the plurality of second openings is formed between the two adjacent first openings, wherein the plurality of first openings and the plurality of second openings are used as slits to induce an interference effect to adjust a beam pattern of the feed horn.

11 Claims, 13 Drawing Sheets

FEED HORN

BACKGROUND OF THE INVENTION

1. Field of the Invention

The present invention relates to a feed horn for a low noise block down-converter, and more particularly, to a feed horn in which a corrugation is formed with a plurality of openings to be slits to induce an interference effect so as to improve a beam pattern and a spillover loss of the feed horn.

2. Description of the Prior Art

An LNBF (Low Noise Block down-converter with Feed horn) is generally disposed on a focal position of a dish reflector and used for gathering satellite signals reflected by the dish reflector and converting the satellite signals into intermediate signals, and then transmitting the intermediate signals to a backend satellite signal processor for signal processing, thereby enabling the playing of satellite television programs.

The LNBF includes a feed horn, a waveguide and a LNB (low noise block down-converter). The feed horn is used for gathering signals reflected by a satellite antenna to the waveguide, to output to the LNB. Besides receiving satellite signals, the feed horn can transmit signals (reflected via the dish reflector) to the satellite for different applications.

Please refer to FIG. 1, which is a schematic diagram of a conventional feed horn 10. The feed horn 10 includes a conical body 11 and a connector 12. The conical body 11 is used for receiving satellite signals reflected by a dish reflector (not shown in FIG. 1). The connector 12 is coupled to the conical body 11 for coupling the feed horn 10 with the waveguide to transmit the satellite signals to the waveguide.

As shown in FIG. 1, the feed horn 10 is traditionally designed with corrugations 110 and 111 inside the feed horn 10; the corrugations 110 and 111 may improve a radiation pattern of the feed horn 10, such that the radiation pattern may be more symmetric and centralized to decrease a spillover loss of the feed horn 10. In general, the lower spillover loss, the higher receiving capability of the satellite signals may be gathered by the dish reflector, which may improve a signal quality of the satellite signals.

Traditionally, the spillover loss may be improved by increasing numbers of the corrugations 110 and 111 or increasing a radius R of the feed horn 10, however, which may increase a volume of the feed horn 10 and a production cost as well. Thus, a feed horn provider may try to design the feed horn having a minimum size to meet a trend of compact size and low cost. Therefore, how to improve the spillover loss without increasing the radius of the feed horn has become a critical consideration for designing the feed horn in the industry.

SUMMARY OF THE INVENTION

It is therefore an object of the present invention to provide a feed horn for an LNB, an interference effect may be induced by openings on the corrugation to adjust a beam pattern and improve a spillover loss of the feed horn.

The present invention discloses a feed horn for a Low Noise Block down converter. The feed horn includes a conical body for gathering satellite signals and a connector coupled to the conical body for coupling the feed horn to a waveguide of the Low Noise Block down converter to transmit the satellite signals to the waveguide. The conical body includes a plurality of corrugations, one of the plurality of corrugations comprises a plurality of first openings, and a plurality of second openings, each of the plurality of second openings is formed between the two adjacent first openings, wherein the plurality of first openings and the plurality of second openings are used as slits to induce an interference effect to adjust a beam pattern of the feed horn.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
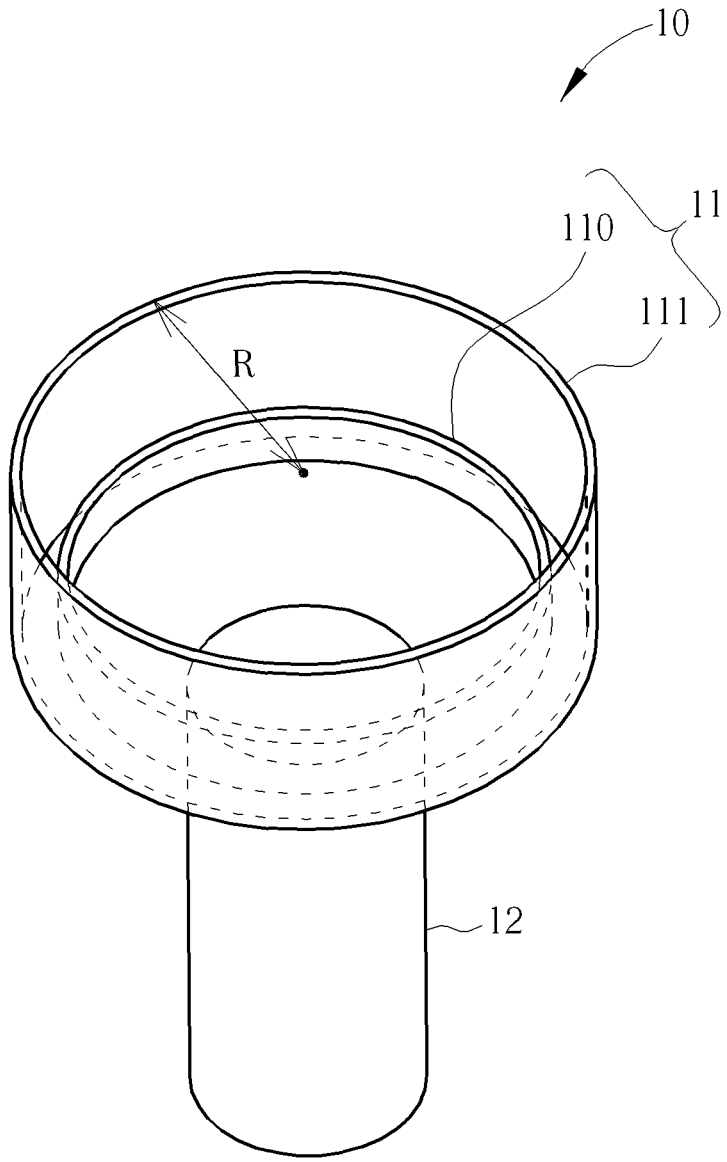
FIG. 1 PRIOR ART
FIG. 1 is a schematic diagram of a conventional feed horn.
Figure 2:
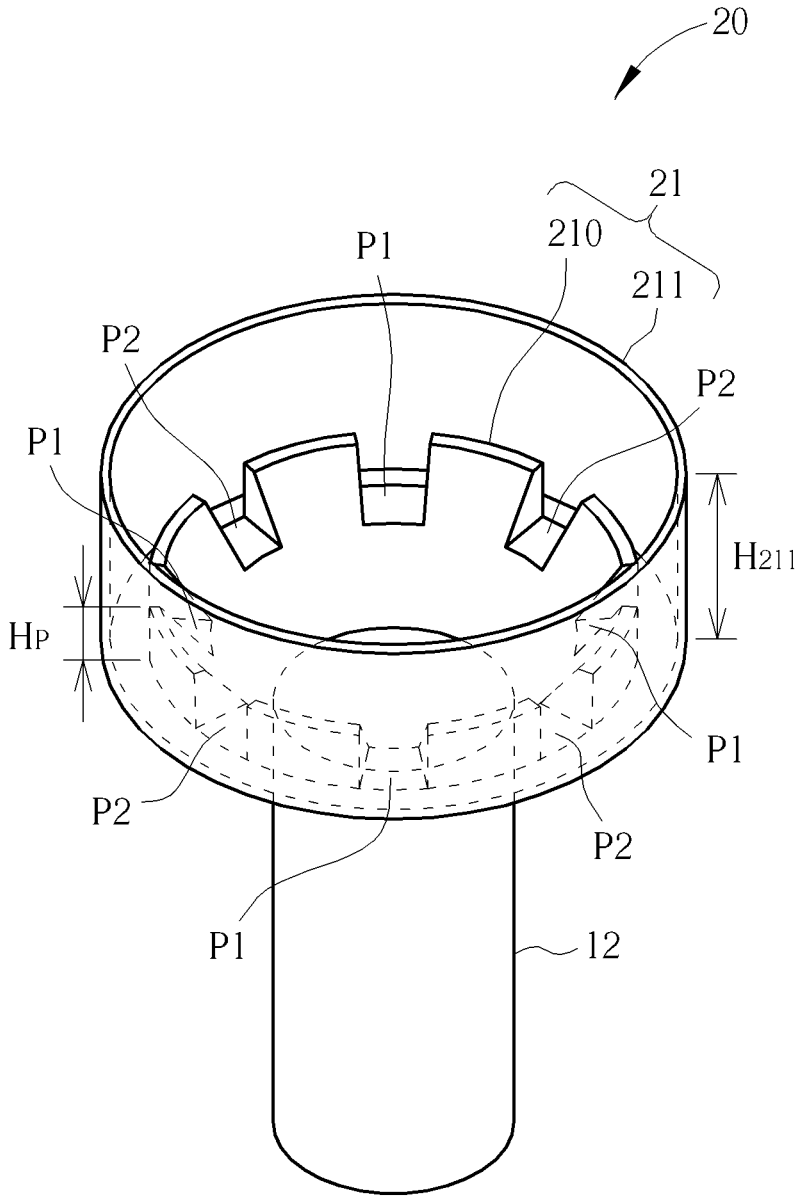
FIG. 2 is a schematic diagram of a feed horn according to an embodiment of the present invention.

Please refer to FIG. 2, which is a schematic diagram of a feed horn 20 according to an embodiment of the present invention. The feed horn 20 includes a conical body 21 and the connector 12. The conical body 21 is used for receiving satellite signals reflected by a dish reflector (not shown in FIG. 2). The connector 12 is coupled to the conical body 21 for coupling the feed horn 20 to a waveguide (not shown in FIG. 2) to transmit the satellite signals to the waveguide. The conical body 21 includes corrugations 210 and 211, wherein the corrugation 210 is formed with a plurality of first openings P1 and a plurality of second openings P2.

As shown in FIG. 2, each of the second openings P2 is formed between the two adjacent first openings P1, and vice versa, each of the first openings P1 is formed between the two adjacent second openings P2. In such a structure, the first opening P1 and the second opening P2 may be regarded as slits on the corrugation 210 to induce an interference effect, which may adjust a beam pattern or a radiation pattern of the feed horn 20 to improve a spillover loss of the feed horn 20.

Noticeably, in order to induce the interference effect to electromagnetic waves, a number of the first opening P1 and a number of the second opening P2 are both three or a positive integer greater than three, i.e. at least three, which means there may be six, eight, ten or greater even numbers of openings formed on one of the corrugations to induce the interference effect in the conical body 21.

Moreover, a corrugation height $H_{211}$ of the corrugation 211 may be adjusted to adjust a beam width of the feed horn 20. An opening height $H_P$ of the first opening P1 and the second opening P2 may be used to adjust beam width and side lobe of the feed horn 20.

Figure 3A:
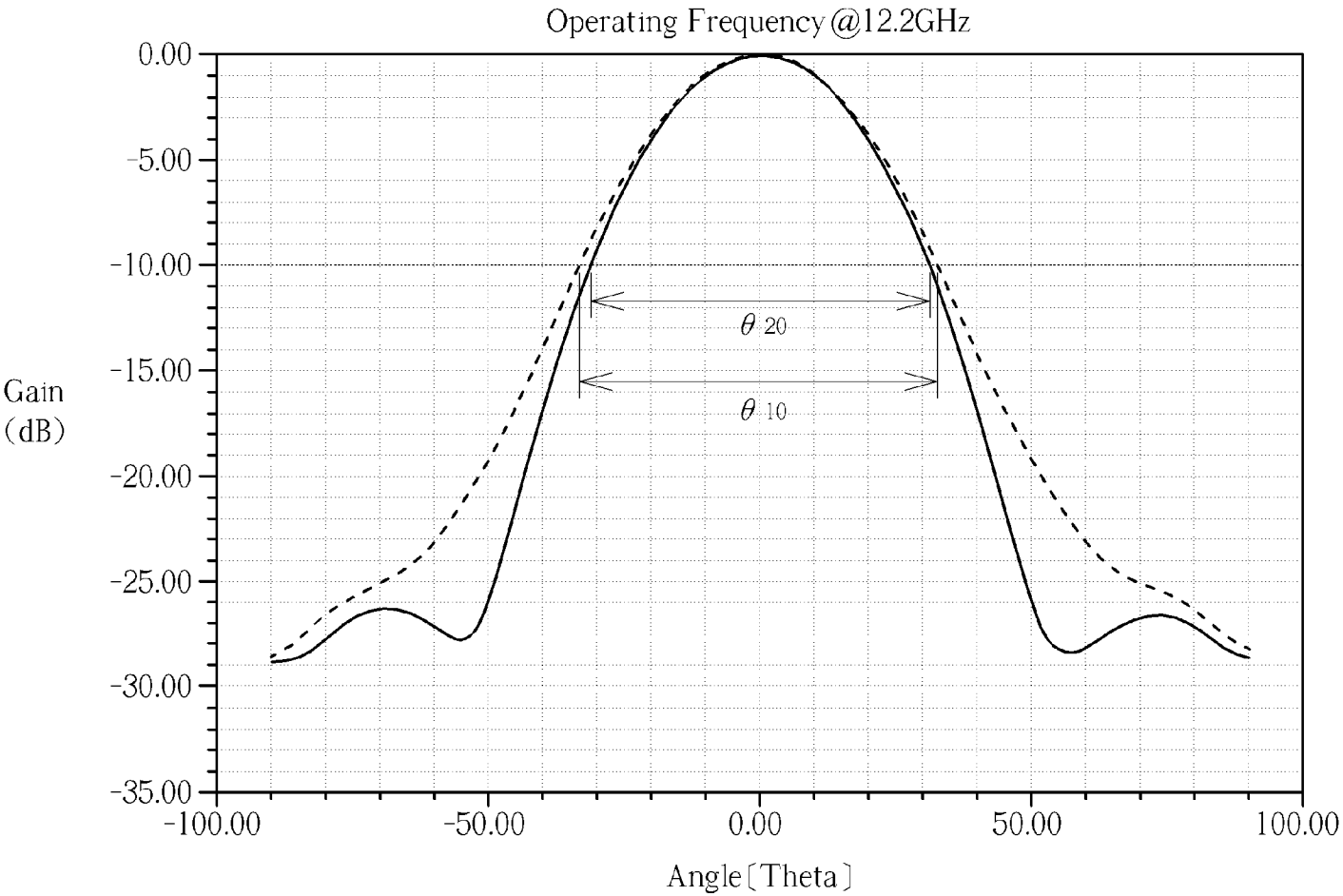
FIG. 3A is a schematic diagram illustrating a comparison between beam patterns of the conventional feed horn shown in FIG. 1 and the feed horn shown in FIG. 2 at an operating frequency 12.2 GHz under a horizontal cutting plane.
Figure 3B:
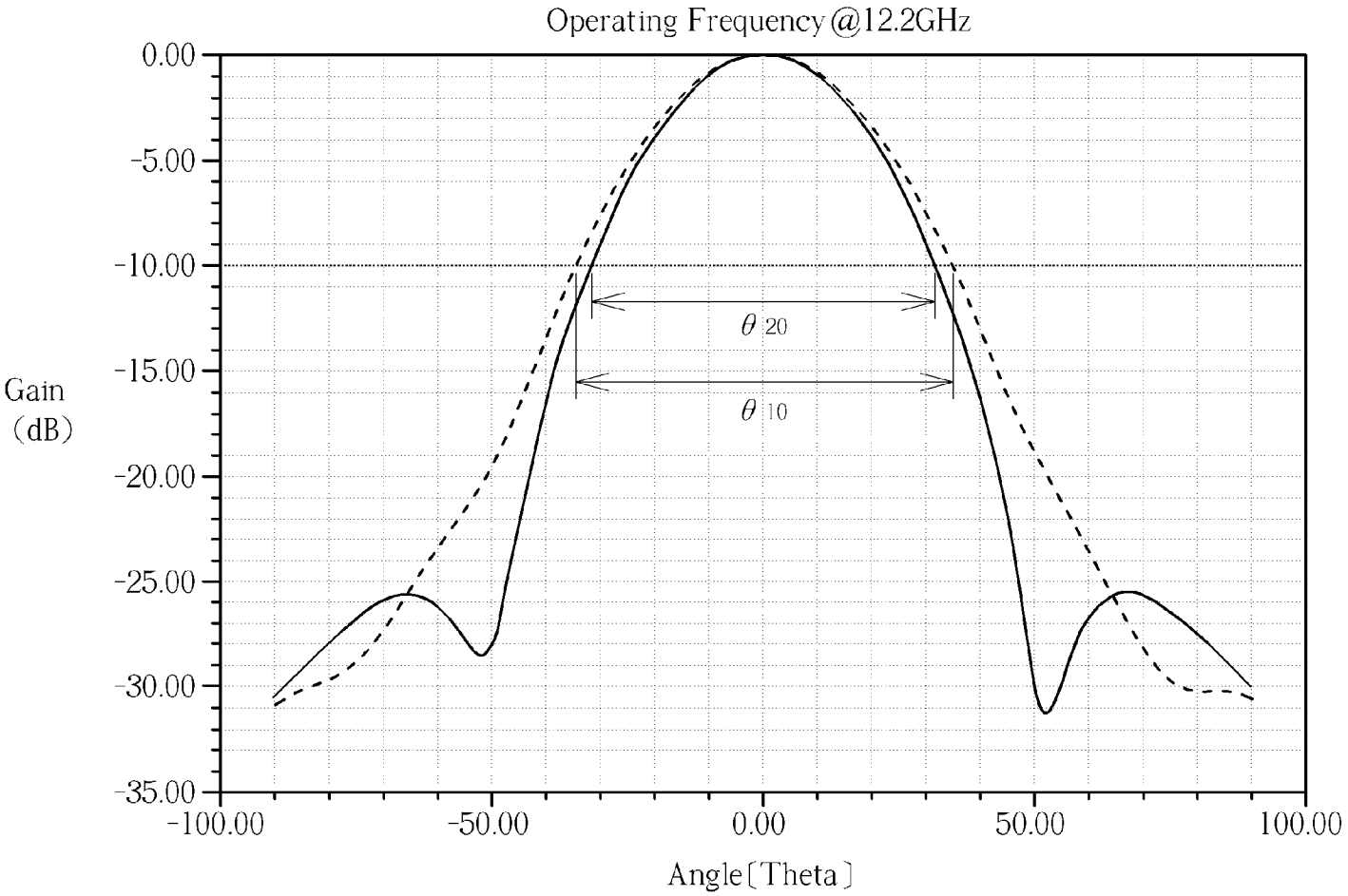
FIG. 3B is a schematic diagram illustrating a comparison between beam patterns of the conventional feed horn shown in FIG. 1 and the feed horn shown in FIG. 2 at an operating frequency 12.2 GHz under a vertical cutting plane.

Please refer to FIG. 3A and FIG. 3B. FIG. 3A is a schematic diagram illustrating a comparison between beam patterns of the conventional feed horn 10 and the feed horn 20 at an operating frequency 12.2 GHz under a horizontal cutting plane. FIG. 3B is a schematic diagram illustrating a comparison between beam patterns of the conventional feed horn 10 and the feed horn 20 at the operating frequency 12.2 GHz under a vertical cutting plane. In FIG. 3A and FIG. 3B, the beam pattern of the feed horn 10 is denoted with a dashed line, the beam pattern of the feed horn 20 is denoted with a solid line.

FIG. 3A compares the beam patterns of the feed horn 20 and 10 in the horizontal cutting plane and shows that side lobes of the feed horn 20, which have the first and second openings P1 and P2, are obviously lower than side lobes of the conventional feed horn 10. Besides, for a 10 dB beam width, a beam width $\theta_{20}$ of a main lobe of the feed horn 20 is narrower than a beam width $\theta_{10}$ of a main lobe of the conventional feed horn 10, i.e. $\theta_{20}<\theta_{10}$. A similar result many observed in FIG. 3B comparing the beam patterns of the feed horn 20 and 10 in the vertical cutting plane. As can be seen, the beam pattern of the feed horn 20 formed with the first and second openings P1 and P2 is more centralized than the beam pattern of the conventional feed horn 10 both in the horizontal and vertical cutting planes. The spillover loss of the feed horn 20 is less than the spillover loss of the conventional feed horn 10, and thus the feed horn 20 may reach a better signal quality.

In short, the present invention is to design the first and second openings P1 and P2 formed on the corrugation 210 of the feed horn 20, such that the first and second openings P1 and P2 may be regarded as slits to induce the interference effect, which may adjust the beam pattern of the feed horn 20 to improve the spillover loss of the feed horn 20, which may be referred to effectively adjust a gain of the feed horn 20.

An advantage of the present invention is that the beam pattern of the feed horn 20 may be adjusted and the spillover loss of the feed horn 20 may be improved without increasing the radius R of the feed horn 20. In other words, a volume and production cost of the feed horn 20 are both unchanged but reach a better performance. Besides, the present invention may further provide a new parameter, i.e. the first and second openings P1 and P2 for designing the feed horn 20, which may increase a design flexibility of the feed horn 20 as well.

Figure 4A:
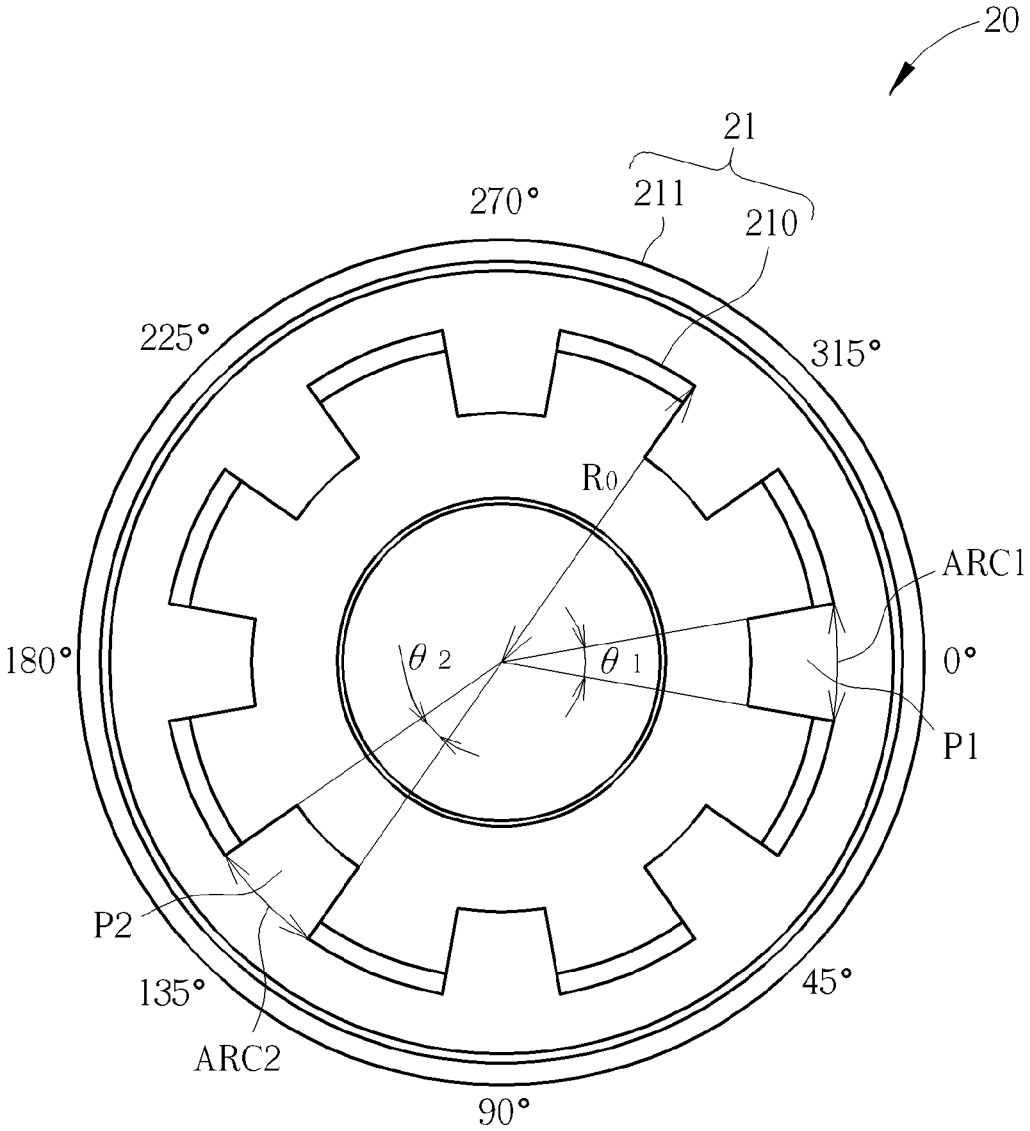
FIG. 4A is a top view of the feed horn shown in FIG. 2.
Figure 4B:
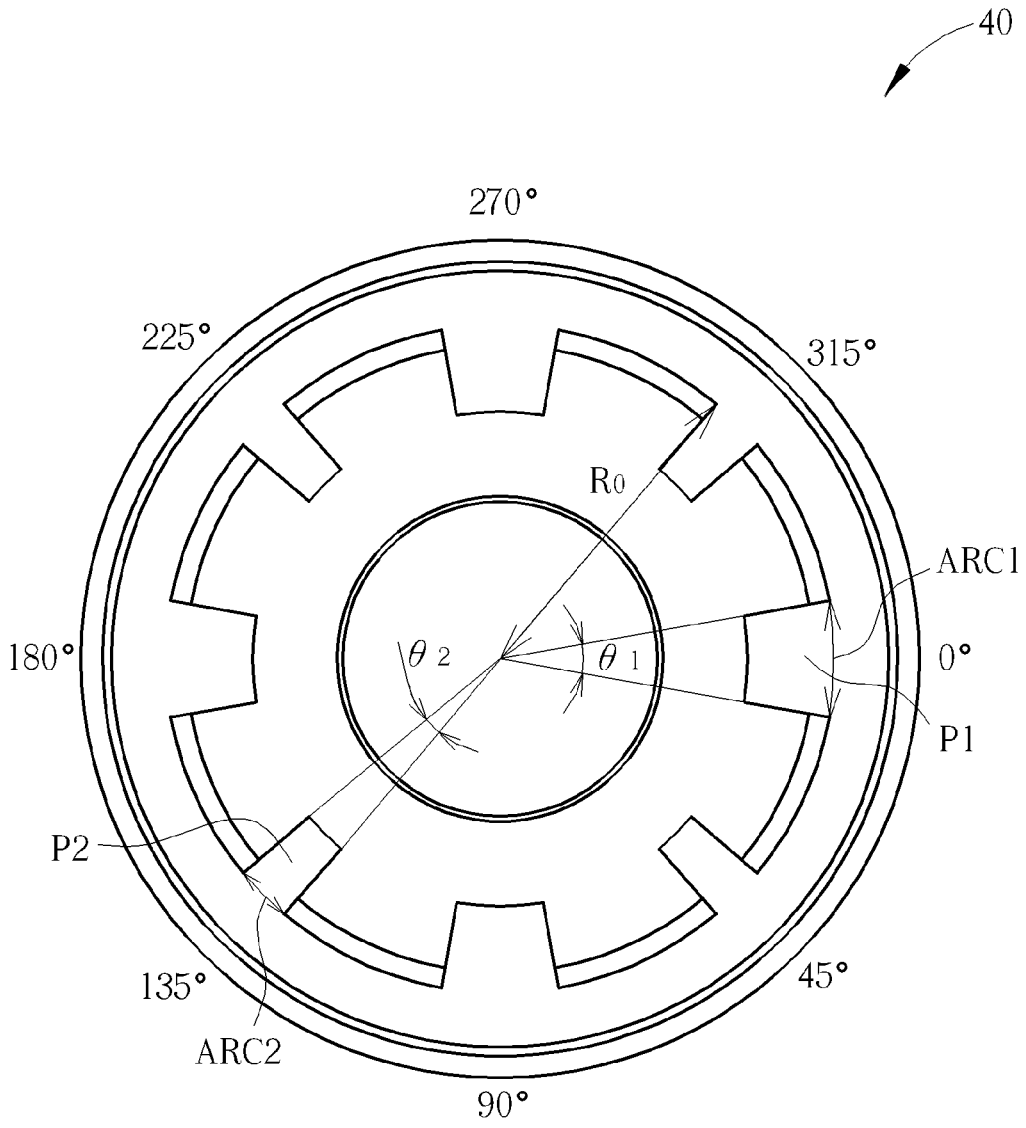
FIG. 4B is a top view of a feed horn according to an embodiment of the present invention.

Please note that those skilled in the art may make modifications or alterations according to above design principles which are not limited to the above embodiments. For example, a designer may adjust an arc, a height, a shape and a position of the first and second openings P1 and P2. Please refer to FIG. 4A and FIG. 4B. FIG. 4A is a top view of the feed horn 20. FIG. 4B is a top view of a feed horn 40 according to another embodiment of the present invention. As shown in FIG. 4A, the four first openings P1 are respectively formed on the corrugation 210 at positions having angles of 0, 90, 180 and 270 degrees, and the four second openings P2 are respectively formed on the corrugation 210 at positions having angles of 45, 135, 225 and 315 degrees. Thus, the interference effect may be induced in the corrugation 210 to adjust beam pattern of the feed horn 20.

On the other hand, a difference between FIG. 4A and FIG. 4B is that a first arc ARC1 of the first opening P1 shown in FIG. 4A is equal to a second arc ARC2 of the second opening P2 shown in FIG. 4A; a first arc ARC1 of the first opening P1 shown in FIG. 4B is unequal to a second arc ARC2 of the second opening P2 shown in FIG. 4B. The first arc ARC1 and the second arc ARC2 may be respectively denoted as:

$$ARC1=R_0*\theta_1$$

$$ARC2=R_0*\theta_2$$

Wherein $R_0$ is a radius of the corrugation 210, $\theta_1$ is a central angle of the first arc ARC1, $\theta_2$ is a central angle of the second arc ARC2. In the embodiments of the present invention, the central angle $\theta_1$ of the first opening P1 and the central angle $\theta_2$ of the second opening P2 are preferably from 10 degrees to 40 degrees. For some applications, the central angle $\theta_1$ of the first opening P1 and the central angle $\theta_2$ of the second opening P2 may be narrower from 15 degrees to 25 degrees.

Figure 5:
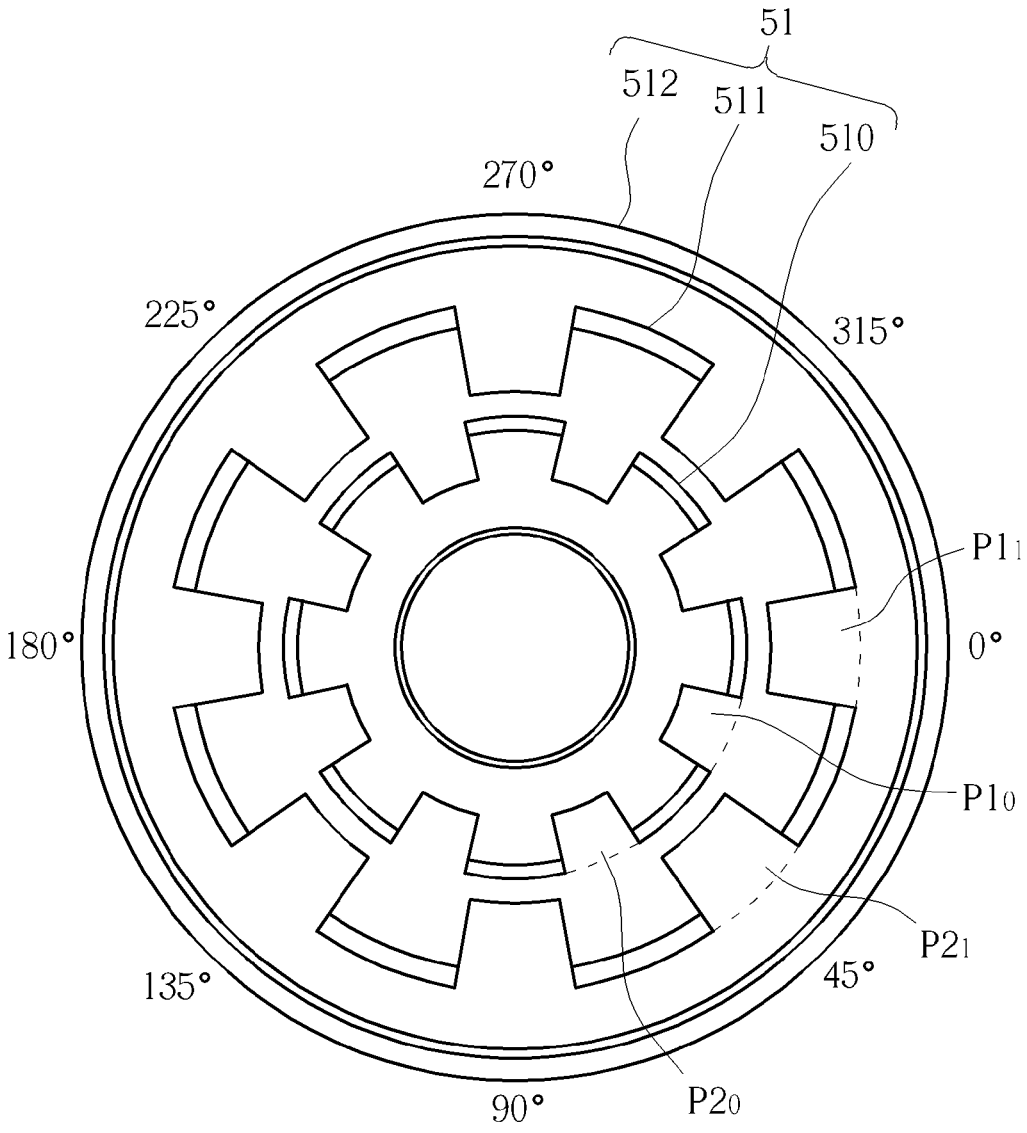
FIG. 5 is a top view of a feed horn according to an embodiment of the present invention.

Please refer to FIG. 5, which is a top view of a feed horn 50 according to an embodiment of the present invention. A conical body 51 of the feed horn 50 includes corrugations 510, 511 and 512. There may be an angle difference between first openings $P1_1$ and $P1_0$ (and second opening $P2_1$ and $P2_0$) respectively formed on the different corrugations 511 and 510, such that each of the first and second openings $P1_1$ and $P2_1$ may be formed at an angle between angles of the two adjacent first and second openings $P1_0$ and $P2_0$. The angle difference may be adjustable according to practical requirements, of course, and the first openings $P1_1$ and $P2_1$ and the second openings $P2_1$ and $P2_2$ may be formed at the same angles though they are formed on different corrugations 510 and 512.

Figure 6:
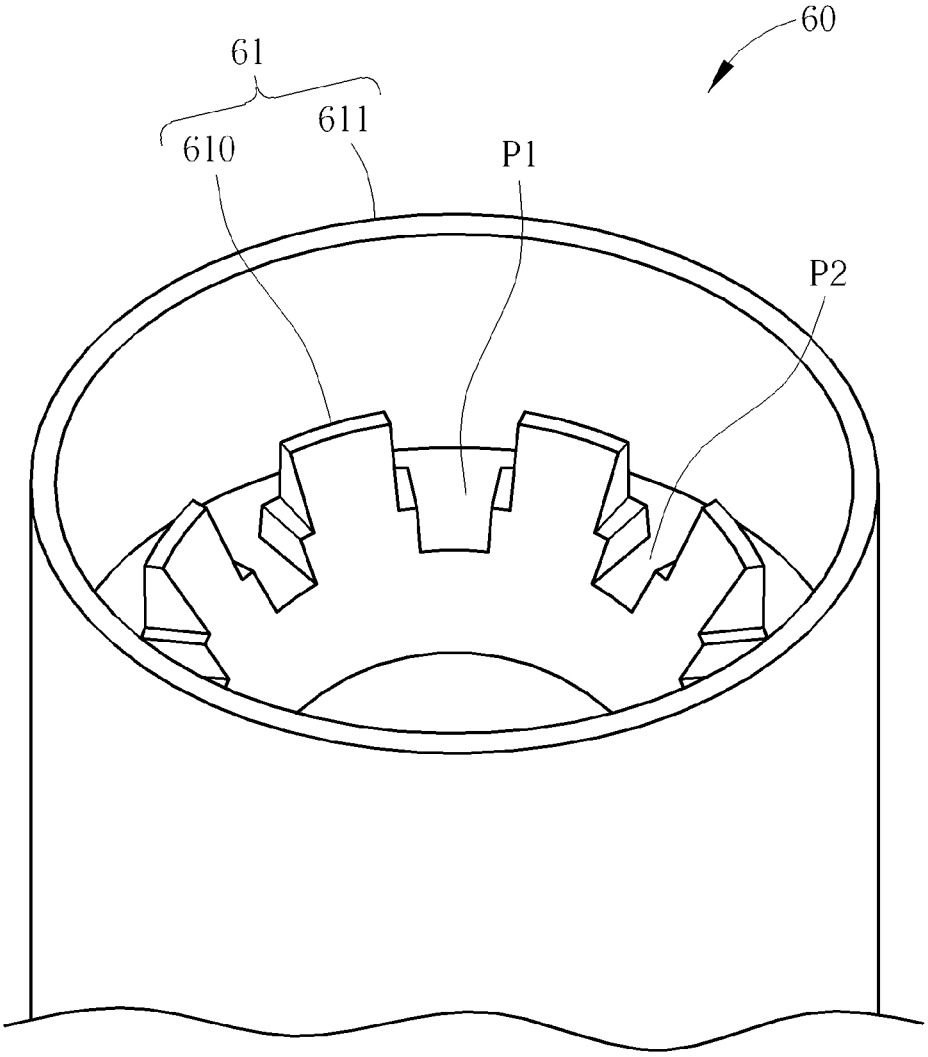
FIG. 6 is a schematic diagram of a feed horn according to an embodiment of the present invention.
Figure 7:
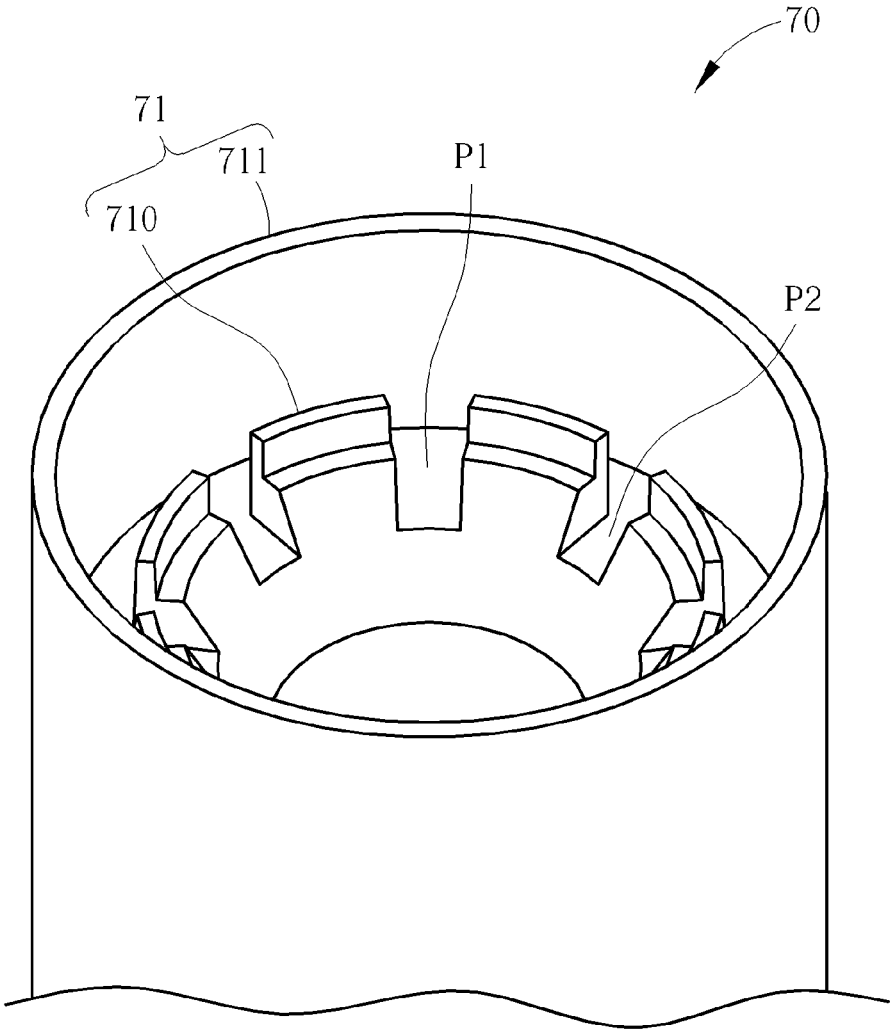
FIG. 7 is a schematic diagram of a feed horn according to an embodiment of the present invention.
Figure 8:
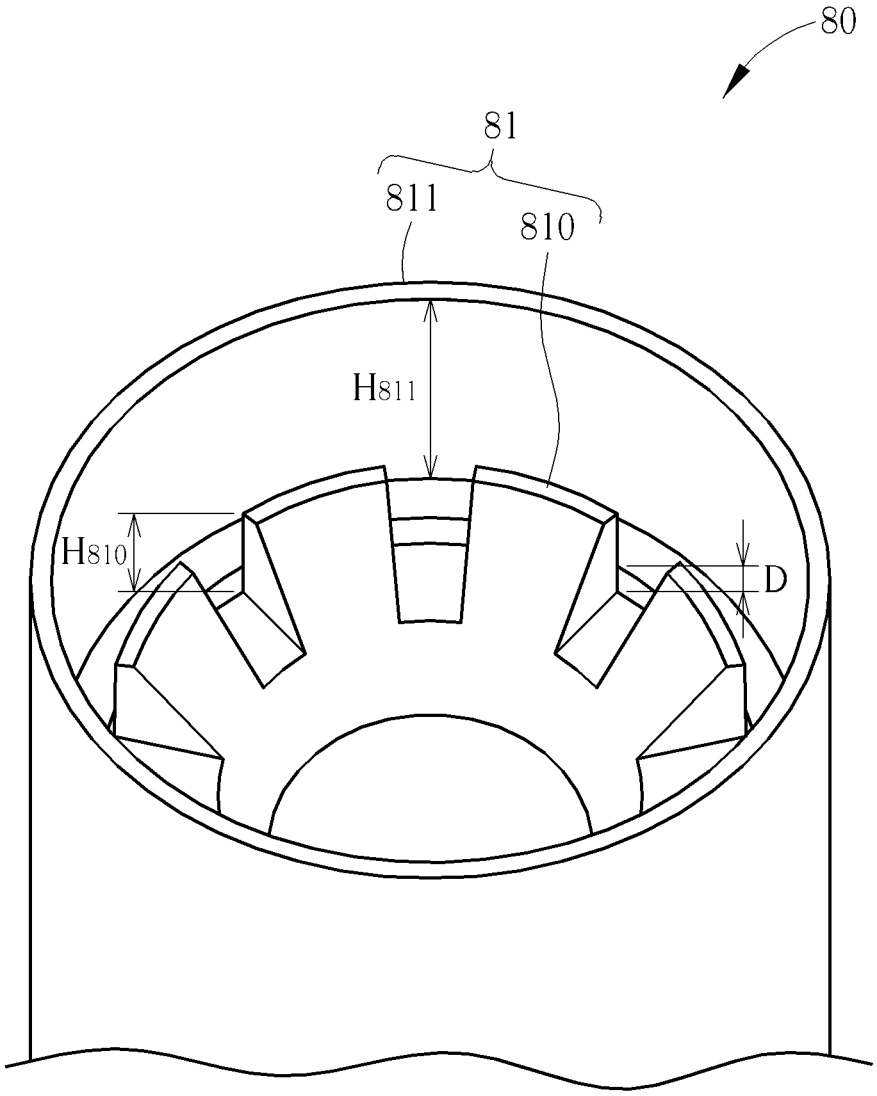
FIG. 8 is a schematic diagram of a feed horn according to an embodiment of the present invention.

Please refer to FIG. 6 to FIG. 10, which are schematic diagrams illustrating first and second openings having different shapes and corrugations having different shapes. As shown in FIG. 6, first and second openings P1 and P2 of a corrugation 610 of a feed horn 60 have a ladder shape. As shown in FIG. 7, a corrugation 710 of a feed horn 70 has a ladder shape. As shown in FIG. 8, a feed horn 80 includes corrugations 810 and 811, wherein there is a relative depth D between a corrugation height $H_{810}$ of the corrugation 810 and a corrugation height $H_{811}$ of the corrugation 811 such that the corrugation height $H_{810}$ is lower than the corrugation height $H_{811}$ under a same horizontal level.

Figure 9:
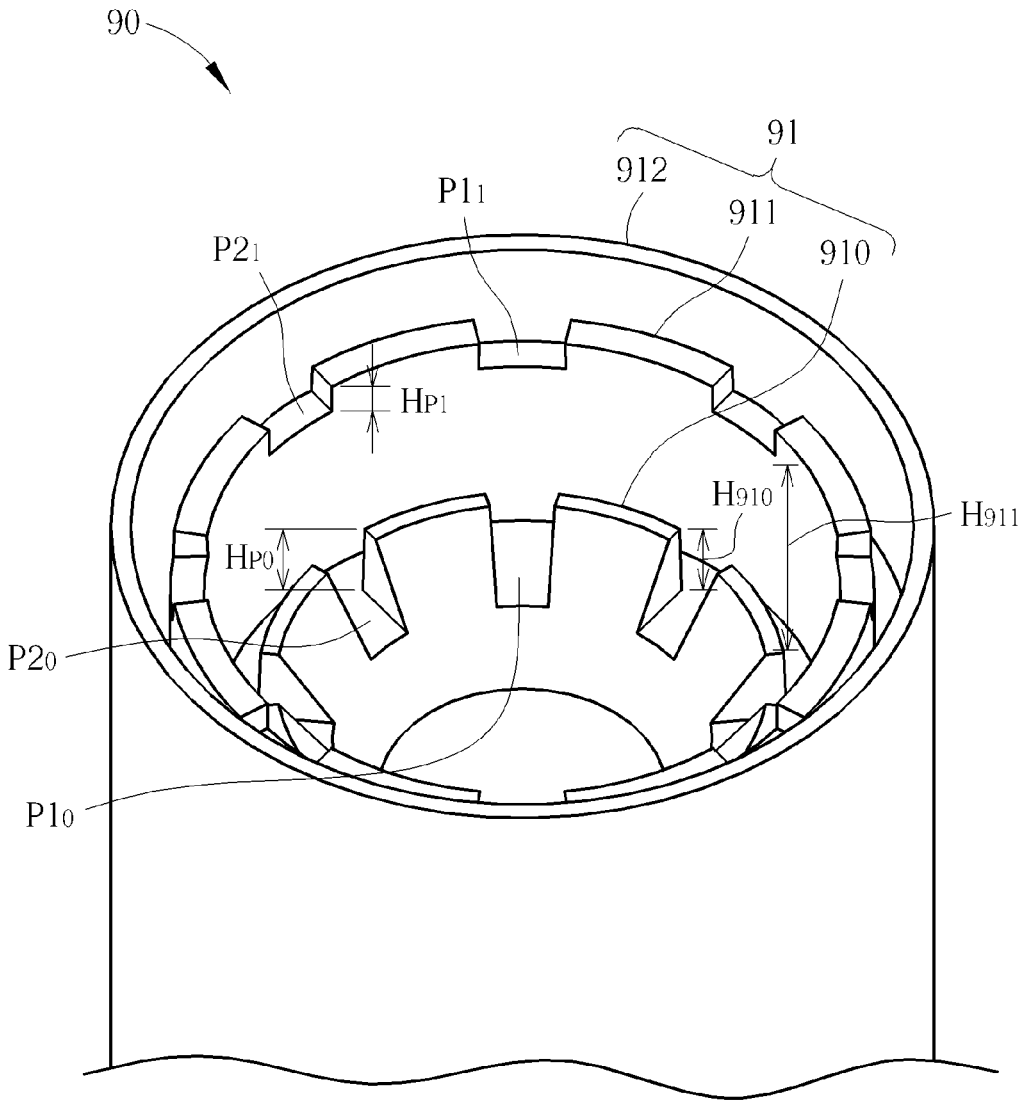
FIG. 9 is a schematic diagram of a feed horn according to an embodiment of the present invention.

As shown in FIG. 9, a conical body 91 of a feed horn 90 includes corrugations 910, 911 and 912. In the corrugation 911, an opening height $H_{P1}$ of a first opening $P1_1$ and a second opening $P2_1$ is less than a corrugation height $H_{911}$ of the corrugation 911. In the corrugation 910, an opening height $H_{P0}$ of a first opening $P1_0$ and a second opening $P2_0$ is equal to a corrugation height $H_{910}$ of the corrugation 910.

Figure 10:
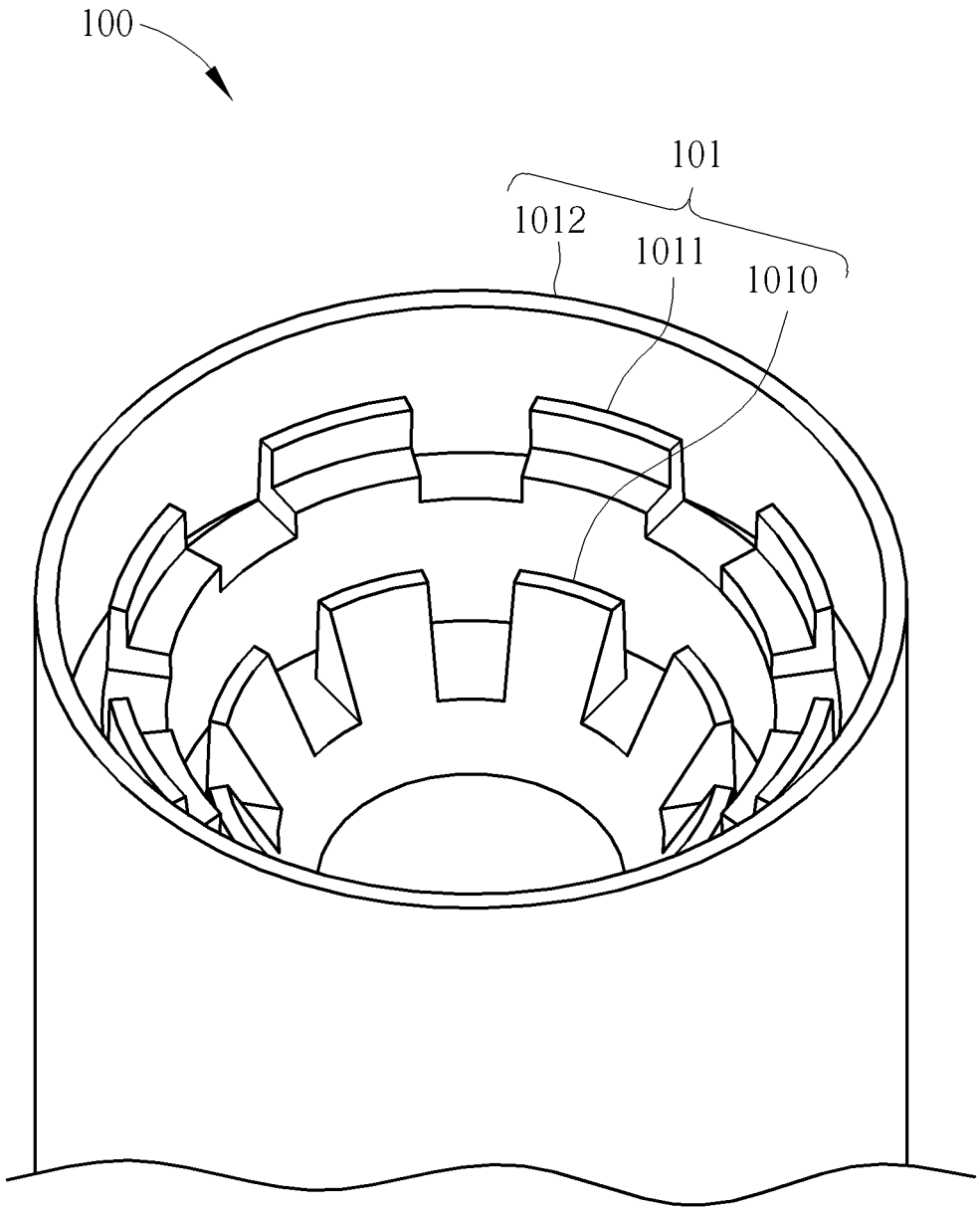
FIG. 10 is a schematic diagram of a feed horn according to an embodiment of the present invention.
Figure 11:
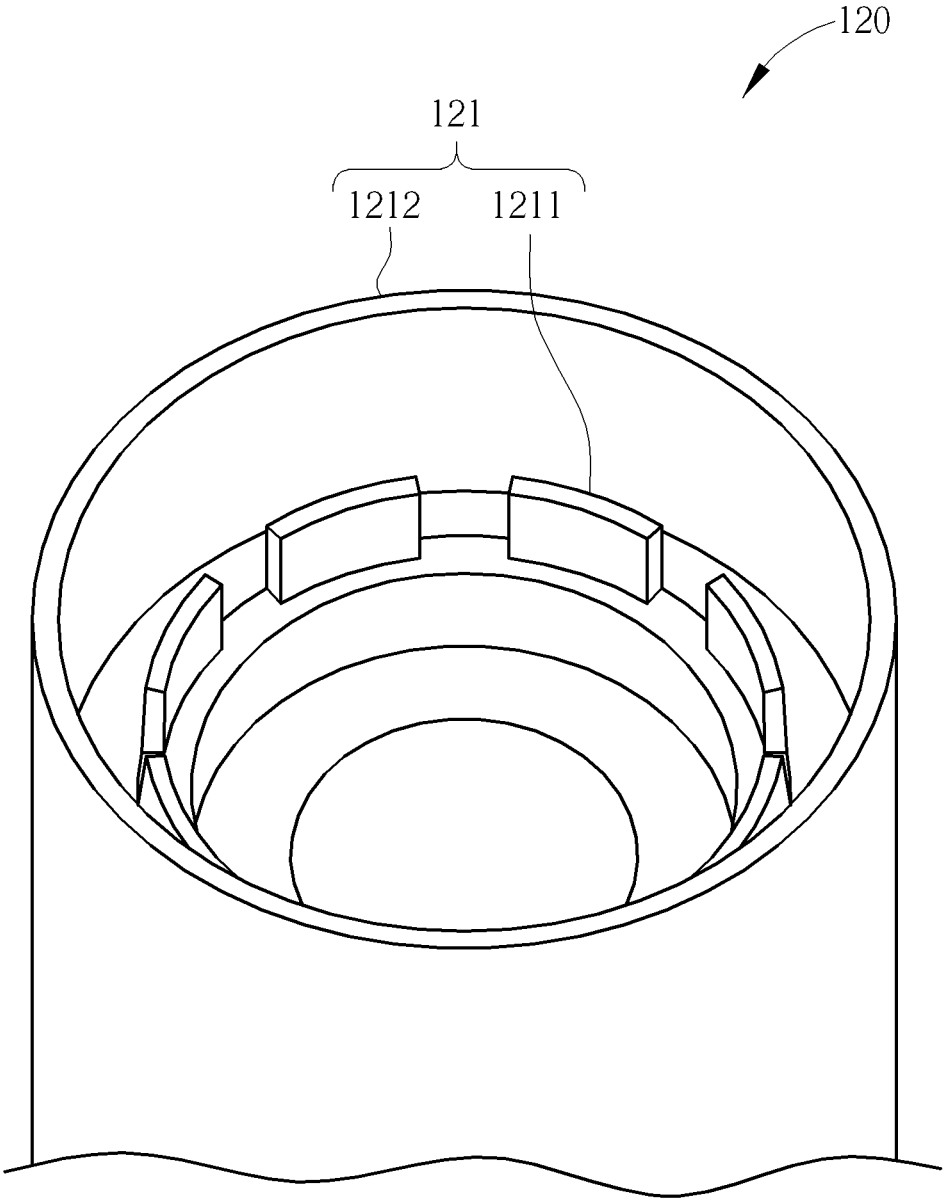
FIG. 11 is a schematic diagram of a feed horn according to an embodiment of the present invention.

As shown in FIG. 10, a conical body 101 of a feed horn 100 includes corrugations 1010, 1011 and 1012, wherein the corrugation 1011 has a ladder shape. As shown in FIG. 11, a conical body 121 of a feed horn 120 includes corrugations 1211 and 1212, wherein the corrugation 1211 has a ladder shape.

To sum up, the present invention is to design the first and second openings formed of the corrugation of the feed horn, such that the first and second openings may be regarded as slits to induce the interference effect, which may adjust the beam pattern of the feed horn, improve the spillover loss of the feed horn and effectively adjust the gain of the feed horn. Therefore, the performance of the feed horn may be improved under the same radius, volume and production cost.

Those skilled in the art will readily observe that numerous modifications and alterations of the device and method may be made while retaining the teachings of the invention.

Accordingly, the above disclosure should be construed as limited only by the metes and bounds of the appended claims.

What is claimed is:

1. A feed horn for an LNB (Low Noise Block down converter), comprising:

a conical body for gathering satellite signals, and comprising a plurality of corrugations, one of the plurality of corrugations comprises:

a plurality of first openings; and a plurality of second openings, each of the plurality of second openings is formed between the two adjacent first openings; and a connector coupled to the conical body for coupling the feed horn to a waveguide of the LNB to transmit the satellite signals to the waveguide;

wherein the plurality of first openings and the plurality of second openings are used as slits to induce an interference effect to adjust a beam pattern of the feed horn.

2. The feed horn of claim 1, wherein a number of the plurality of first openings is 3 or a positive integer greater than 3, and a number of the plurality of second openings is 3 or a positive integer greater than 3.

3. The feed horn of claim 1, wherein one of the plurality of corrugations has a corrugation height, the corrugation height is relative to a beam width of a main lobe of the feed horn.

4. The feed horn of claim 3, wherein there is a relative depth between a first corrugation and a second corrugation, such that a corrugation height of the first corrugation is lower than a corrugation height of the second corrugation under a same horizontal level.

5. The feed horn of claim 1, wherein each of the first openings and the second openings has an opening height, the opening height is relative to a beam width of a side lobe of the feed horn.

6. The feed horn of claim 1, wherein the first opening has a first arc, the second opening has a second arc, the corrugation formed with the first and second openings has a corrugation radius, wherein the first arc and the second arc are respectively denoted as:

$$ARC1=R_0*\theta_1$$

$$ARC2=R_0*\theta_2$$

wherein ARC1 is the first arc, ARC2 is the second arc, $R_0$ is the corrugation radius, $\theta_1$ is a central angle of the first opening, $\theta_2$ is a central angle of the second opening.

7. The feed horn of claim 6, wherein the central angle of the first opening is unequal to the central angle of the second opening.

8. The feed horn of claim 6, wherein the central angle of the first opening is equal to the central angle of the second opening.

9. The feed horn of claim 8, wherein the central angle of the first opening and the central angle of the second opening are substantially from 10 degrees to 40 degrees.

10. The feed horn of claim 1, wherein one of the plurality of corrugations has a ladder shape.

11. The feed horn of claim 1, wherein the first opening and the second opening have a ladder shape.

* * * * *